United States Patent [19]

Kologiy

[11] Patent Number: 4,673,129

[45] Date of Patent: Jun. 16, 1987

[54] GUTTER CLEANER

[76] Inventor: George J. Kologiy, c/o T. Beard, 1 Ritz Pl., Lindenhurst, N.Y. 11757

[21] Appl. No.: 847,770

[22] Filed: Apr. 3, 1986

[51] Int. Cl.[4] ..... B05B 1/32

[52] U.S. Cl. ..... 239/532; 251/9

[58] Field of Search ..... 251/9,7; 239/532; 285/303; 15/236 R

[56] References Cited

U.S. PATENT DOCUMENTS

| | | | |
|---|---|---|---|
| 2,910,711 | 11/1959 | Mizelle | 239/532 UX |
| 3,023,971 | 3/1962 | Milhous | 239/532 X |
| 3,041,655 | 7/1962 | Entler | 15/236 R |
| 4,084,067 | 4/1978 | Gillemot | 285/303 X |
| 4,247,076 | 1/1981 | Larkin | 251/9 X |
| 4,303,348 | 12/1981 | O'Brien | 239/532 X |

FOREIGN PATENT DOCUMENTS

| | | | |
|---|---|---|---|
| 1016330 | 11/1952 | France | 239/532 |

*Primary Examiner*—Andres Kashnikow

*Attorney, Agent, or Firm*—Richard L. Miller

[57] ABSTRACT

A gutter cleaner for the removal of debris from gutters and leaders is provided and consists of tubular handle bent at a right angle at one end forming a short length and having a conventional garden hose fitting affixed to the other end connected to a garden hose and water faucet. A valve is mounted in line in the handle. The individual using the gutter cleaner stands on the ground and places the short length into the gutter and controls water flow into the gutter with valve. A modification of the above includes a housing which carries a wand with a short length similar to the short length described, wherein the wand is screwed to the garden hose within the housing. The length of the protrusion of short length from the housing thereby becoming adjustable.

3 Claims, 4 Drawing Figures

GUTTER CLEANER

BACKGROUND OF THE INVENTION

This invention relates generally to a cleaning method using water; and more particularly to a gutter cleaner.

It has been generally known for many years that water can be employed for the purpose of cleaning various forms of accumulated matter. Water under pressure, normally available at faucets of homes, is often used to remove debris from rain gutters, leaders and downspouts. This method usually requires the individual to climb a ladder with great threat to personal safety. In addition this method is inconvenient and unnecessarily time consuming.

Therefore, there exists the need for a convenient, safe, economical gutter cleaner.

SUMMARY OF THE INVENTION

It is an object of this invention to provide a new and improved gutter cleaner.

It is another object of this invention to provide a new and improved gutter cleaner operable from the ground.

It is yet another object of this invention to provide a new and improved gutter cleaner using a garden hose.

It is still another object of this invention to provide a new and improved gutter cleaner using commercially available plumbing fittings.

It is further object of this invention to provide a new and improved gutter cleaner with an adjustable end.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
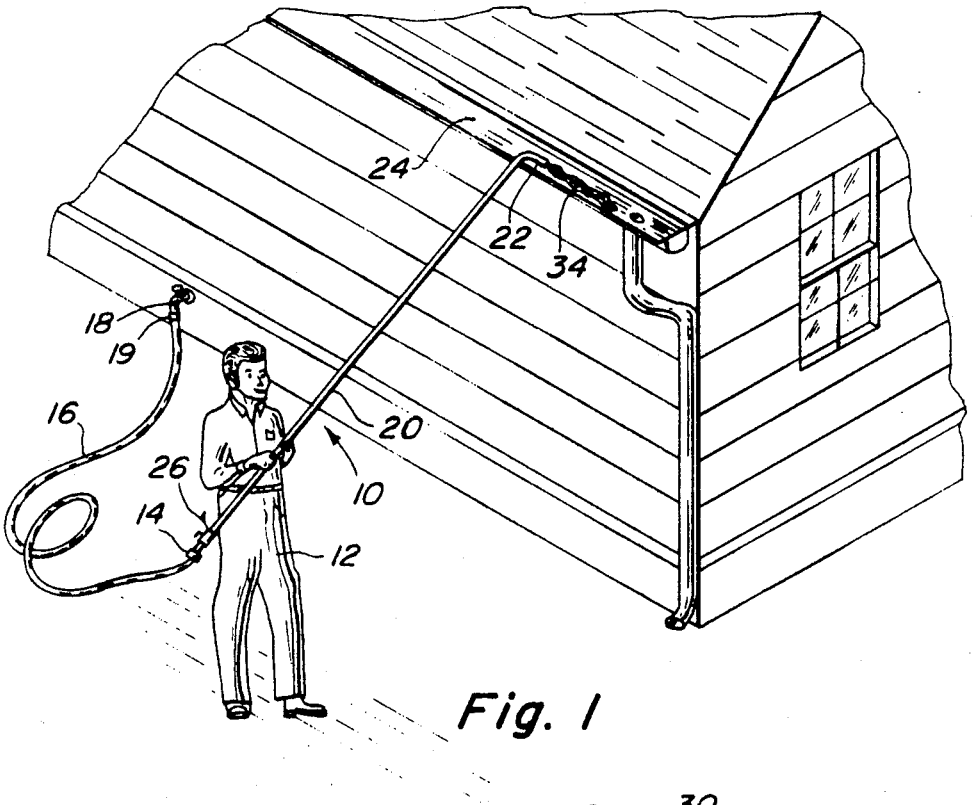
FIG. 1 is a perspective view of the invention being used to clean out gutters on a house.
Figure 2:
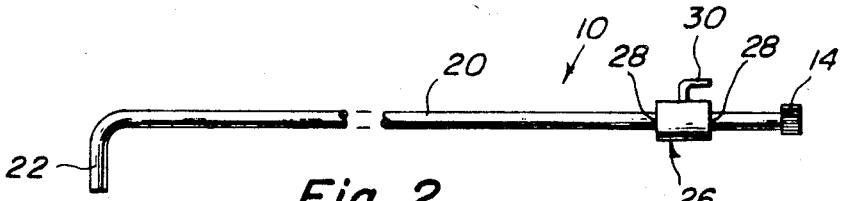
FIG. 2 is a side view of the invention.
Figure 3:
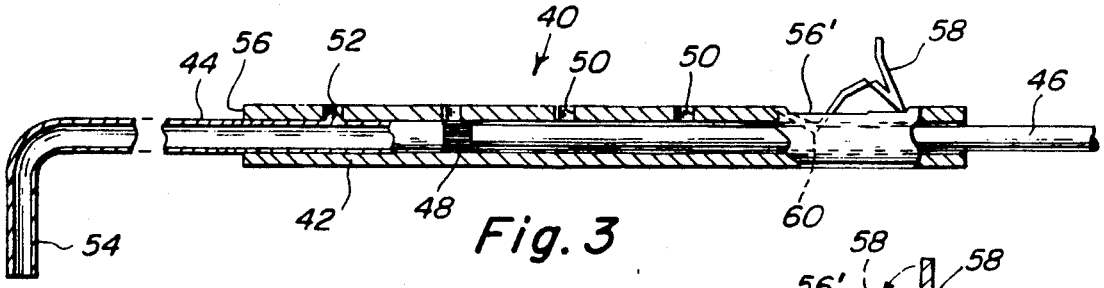
FIG. 3 is a side view partly in cross section of a modification thereof.
Figure 4:
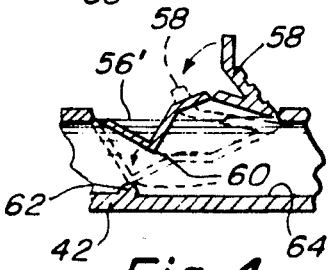
FIG. 4 is an enlarged cross sectional view of the clamp valve in FIG. 3.

With reference to FIG. 1 there is generally shown a gutter cleaner 10 deployed in use by an individual 12. Gutter cleaner 10 is attached at a fitting 14 which is commercially available. Fitting 14 is internally threaded and connected to a garden hose 16 which is also conventional. Hose 16 is conventionally affixed to faucet 18 with fitting 19. A handle 20 of gutter cleaner 10 is held by individual 12 so that a short length 22 is deployed in gutter 24. In FIG. 2 it is shown that integral to handle 20, of a predetermined length, constructed of ½" tube is a short length 22 (approximately 4" to 8") bent at 90° to handle 20. Proximate fitting 14 a valve 26 is disposed in line with handle 20 at junctions 28. Connection at junctions 28 of valve 26 and handle 20 is accomplished by threading, soldering or other established methods, as is attachment of fitting 14 to handle 20. A shut off lug 30 of valve 26 is attached to an inner valve device in the form of a ball or disc (not shown). Individual 12 coacts with lug 30 to open and close valve 26 allowing a stream of water 34 to flow in gutter 24. In the embodiment shown in FIG. 3 there is generally shown a gutter cleaner 40 comprised of a housing 42 within which are disposed a wand 44 and a garden hose 46 commercially available with a fitting 48. Wand 44 has an external thread which is threaded into fitting 48 in a conventional manner. Housing 42 is a tubular member of predetermined length with a set of holes 50 which coact with detent 52 formed on the periphery of wand 44. Positioning of detent 52 into various holes 50 determines the amount of extension of a short length 54 from a first end 56 of housing 42. Short length 54 is similarly formed as an integral part of wand 44 as is short length 22 of the first embodiment. A handle slot 56' is disposed in the periphery of housing 42 and is of a predetermined size to allow the mounting of a shut off device 58. Device 58 is commercially available and when compressed a contact edge 60 coacts with teat 62 formed on an inside surface 64 of housing 42 disposed 180° from handle slot 56. Coaction of edge 60 and teat 62 collapses hose 46 thereby stopping water flow. Otherwise this embodiment is similar to that previously described.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A gutter cleaner, comprising:

(a) a housing of tubular form;

(b) a wand of tubular form with an integral short length disposed at a first end of said wand, said wand of a diametrical size to allow insertion into said housing, said wand having an external thread at a second end of said wand;

(c) a garden hose which connects to said external thread of said wand;

(d) a fitting interconnecting said second end of said wand to said garden hose, said tubular housing receiving therein said fitting and straddling it to cover a portion of said wand adjacent said second end and a portion of said garden hose adjacent to the connection to the fitting, whereby said housing provides a handle for use and also protects the connection of the hose and wand, and (e) a shut off device, said shut off device affixed proximate the first end of said housing in a slot on the periphery of said housing and coacting with said garden hose, whereby fluid flowing in said garden hose may be shut off by said shut off device.

2. The gutter cleaner of claim 1, wherein said housing has a plurality of holes cut through a wall of said housing, said holes coacting with a detent formed on the outer periphery of said wand, when said detent is disposed in various said holes corresponding change in the amount of protrusion from a second end of said housing results, and whereby said shut off device continues to coact with a portion of the garden hose regardless of the positioning of of the detent.

3. The gutter cleaner of claim 1, wherein an edge of said shut off device coacts with a teat disposed on an internal surface of said housing, said teat disposed 180° relative to said slot of said housing when said shut off device is activated to stop water flow through said garden hose.

* * * * *